US011821425B2

(12) United States Patent
Yano

(10) Patent No.: US 11,821,425 B2
(45) Date of Patent: Nov. 21, 2023

(54) PUMP SHAFT SUPPORT STRUCTURE

(71) Applicant: KAWASAKI MOTORS, LTD., Akashi (JP)

(72) Inventor: Takahiro Yano, Akashi (JP)

(73) Assignee: KAWASAKI MOTORS, LTD.

( * ) Notice: Subject to any disclaimer, the term of this patent is extended or adjusted under 35 U.S.C. 154(b) by 0 days.

(21) Appl. No.: 17/719,208

(22) Filed: Apr. 12, 2022

(65) Prior Publication Data

US 2023/0323875 A1 Oct. 12, 2023

(51) Int. Cl.
*F04C 2/10* (2006.01)
*F02B 75/00* (2006.01)
*F01M 1/02* (2006.01)

(52) U.S. Cl.
CPC ..... *F04C 2/10* (2013.01); *F02B 75/007* (2013.01); *F04C 2/102* (2013.01); *F01M 2001/0238* (2013.01); *F01M 2001/0284* (2013.01); *F04C 2210/206* (2013.01); *F04C 2240/20* (2013.01); *F04C 2240/30* (2013.01); *F04C 2240/60* (2013.01)

(58) Field of Classification Search
CPC .... F01M 2001/0238; F01M 2001/0284; F04C 2/10–102; F04C 18/10; F04C 18/102; F04C 18/103; F01C 1/10–103; F02B 75/007
See application file for complete search history.

(56) References Cited

U.S. PATENT DOCUMENTS 4,911,119 A * 3/1990 Ohno ..... F04C 11/00 184/26
4,974,562 A * 12/1990 Ishii ..... F01M 1/02 123/198 C
5,065,841 A * 11/1991 Takagaki ..... F01M 1/02 123/196 R
2006/0292024 A1* 12/2006 Miyake ..... F04C 2/086 418/61.2

* cited by examiner

*Primary Examiner* — Laert Dounis
(74) *Attorney, Agent, or Firm* — SNELL & WILMER LLP

(57) ABSTRACT

A pump shaft support structure includes: a crankcase body which rotatably supports a crankshaft of an engine; a pump shaft which interlockingly rotates with the crankshaft; a crankcase cover which covers the crankcase body; a pump cover which is coupled to the crankcase cover to define a pump chamber therebetween; and a pump rotor which is disposed in the pump chamber and engages with the pump shaft. The pump shaft includes: a supported section which is rotatably supported by the pump cover on the other side of the pump chamber from the crankcase cover; and an insertion section adjoining the supported section in an axial direction. The pump cover has a through bore which passes the insertion section of the pump shaft therethrough. The insertion section of the pump shaft has a diameter smaller than that of the supported section.

14 Claims, 10 Drawing Sheets

PUMP SHAFT SUPPORT STRUCTURE

BACKGROUND OF THE INVENTION

Field of the Invention

The present disclosure relates to a pump shaft support structure for the support of a pump shaft which interlockingly rotates with a crankshaft of an engine.

Description of Related Art

In the process of inserting a pump shaft through a bearing so that the pump shaft is supported on the bearing, the pump shaft can hit and damage a sliding surface of the bearing.

SUMMARY OF THE INVENTION

The present disclosure provides a pump shaft support structure which can prevent possible damage to a bearing.

The present disclosure provides a pump shaft support structure. The structure includes: a crankcase which rotatably supports a crankshaft of an engine; a pump shaft which interlockingly rotates with the crankshaft; a supported section which is rotatably supported and an insertion section adjoining the supported section in an axial direction; a pump cover which is detachably coupled to the crankcase to define a pump chamber between the pump cover and the crankcase and which rotatably supports the supported section of the pump shaft on the other side of the pump chamber from the crankcase, which pump cover has a through bore that passes the insertion section of the pump shaft therethrough; and a pump rotor which is disposed in the pump chamber and engages with the insertion section of the pump shaft. The insertion section of the pump shaft has a diameter smaller than a diameter of the supported section.

According to such a configuration, the insertion section of the pump shaft is designed to have a diameter smaller than a diameter of the supported section. This makes it easy for the insertion section of the pump shaft to be inserted into and pass through a bearing section of the pump cover by providing and maintaining a radial gap therebetween. Hence, it can keep the insertion section of the pump shaft from hitting a bearing surface, i.e., a sliding surface, of the pump cover, in the process of establishing support for the pump shaft. Thus, the occurrence of a contact damage caused by the hitting of the insertion section of the pump shaft can be mitigated. Therefore, possible damage to a bearing can be prevented.

Any combinations of at least two features disclosed in the appended claims and/or the specification and/or the accompanying drawings should be construed as included within the scope of the present disclosure. In particular, any combinations of two or more of the appended claims should be equally construed as included within the scope of the present disclosure.

BRIEF DESCRIPTION OF THE DRAWINGS

In any event, the present disclosure will become more clearly understood from the following description of preferred embodiments thereof, when taken in conjunction with the accompanying drawings. However, the embodiments and the drawings are given only for the purpose of illustration and explanation, and are not to be taken as limiting the scope of the present disclosure in any way whatsoever, which scope is to be determined by the appended claims. In the accompanying drawings, like reference signs are used to denote like or corresponding parts throughout different figures, and:

DESCRIPTION OF EMBODIMENTS

Figure 1:
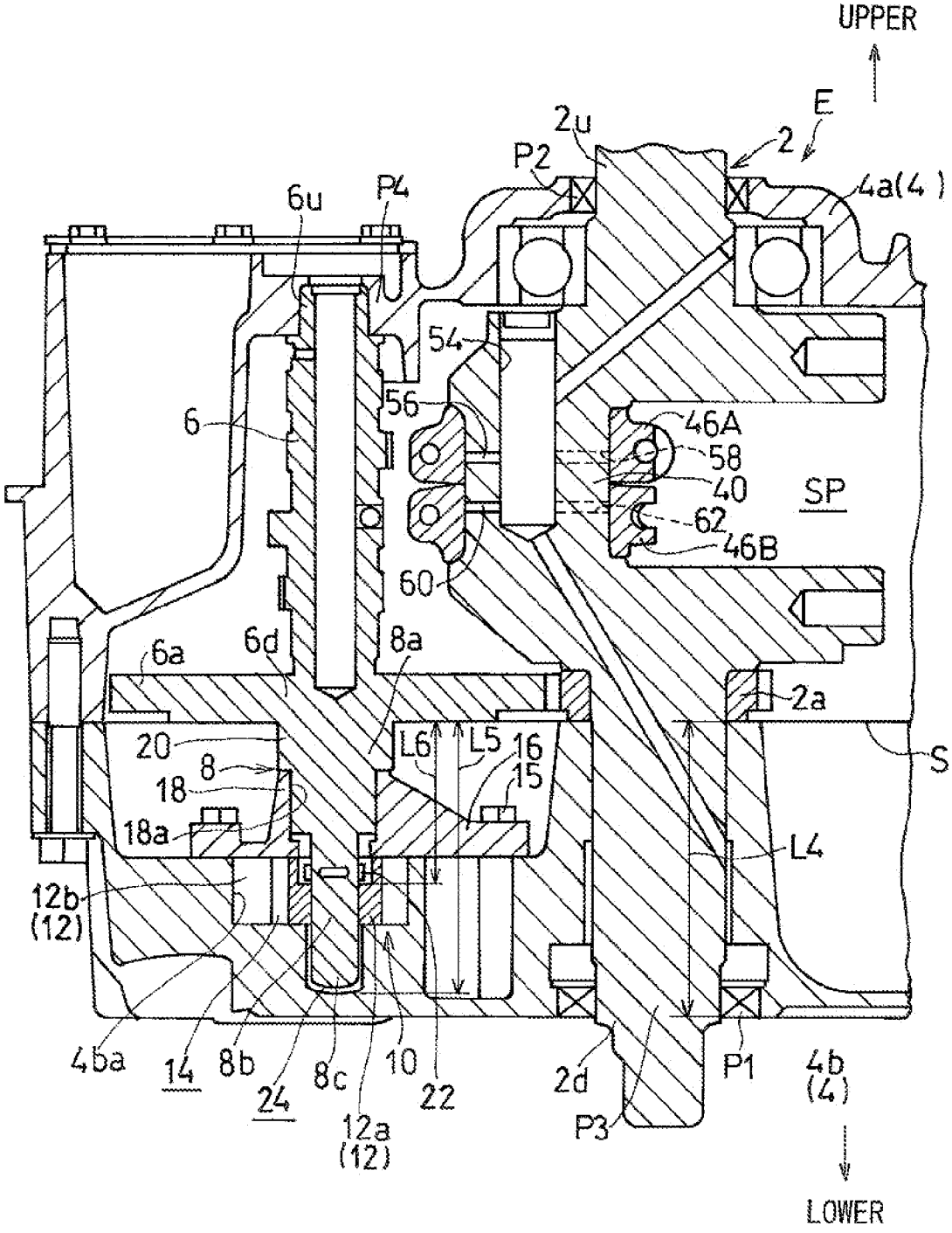
FIG. 1 shows a cross sectional view of an engine comprising a pump shaft support structure, in accordance with the first embodiment of the present disclosure.

Preferred embodiments of the present disclosure will be described in conjunction with the accompanying drawings. FIG. 1 shows a cross sectional view of an engine E comprising a pump shaft support structure, in accordance with the first embodiment of the present disclosure. The engine E according to the present disclosure is a vertical shaft engine in which a crankshaft 2 serving as a rotary shaft of the engine extends in a vertical direction. For instance, the engine E according to the present disclosure is in the form of a V-twin cylinder vertical shaft engine. Further, the engine E according to the present disclosure is of a four-stroke overhead valve (OHV) design in which an intake and exhaust valving mechanism is disposed in a cylinder head. The engine E according to the present disclosure is, for example, used for a riding lawn mower. However, these are merely non-limiting examples of the configuration and use of said engine.

In the present embodiment, the engine E includes: an engine case 4 in which the crankshaft 2 can be housed; and a camshaft 6 which interlockingly rotates with the crankshaft 2. The engine case 4 comprises a supporting structure for rotatably supporting the crankshaft 2 at opposite ends of the crankshaft 2 in an axial direction. The engine case 4 includes a crankcase body 4*a* and a crankcase cover 4*b*. The crankcase body 4*a* defines a housing volume SP for housing the crankshaft 2.

The crankcase cover 4*b* can be detachably coupled to the crankcase body 4*a* and can close the housing volume SP when coupled to the crankcase body 4*a*. In the present embodiment, the engine case 4 is of an upper-lower, two-part split construction in which the crankcase cover 4*b* can be detachably coupled to a bottom end of the crankcase body 4*a*. Hereinafter, one axial side of a shaft may be referred to as lower or as a lower side, whereas the other axial side of the same shaft may be referred to as upper or as an upper side. In the present embodiment, the crankcase cover 4*b* provides a cover-side bearing section P1 where an end of the crankshaft 2 on one axial side thereof, namely, a lower end 2*d*, can be rotatably supported. The crankcase body 4*a* provides a case-side bearing section P2 where an end of the crankshaft 2 on the other axial side thereof, namely, an upper end 2*u*, can be rotatably supported.

The camshaft 6 serves as a component of a valve train that is configured to open and close intake and exhaust valves on the cylinders of the engine E. In addition to the camshaft, push rods and rocker arms, which will be discussed later, are also included in the valve train. The camshaft is configured to receive rotary power from the crankshaft and convert the same into a reciprocating motion which will be transferred via the push rods and the rocker arms to the intake and exhaust valves. In this way, the intake and exhaust valves can be driven in coordination with rotations of the crankshaft so as to open and close associated intake and exhaust ports, respectively.

The camshaft 6 is configured to extend parallel to the crankshaft 2, i.e., extend in a vertical direction. The camshaft 6 can be housed in the same housing volume for housing the crankshaft 2. In particular, the camshaft 6 can be arranged in a portion of that volume which is proximal to a combustion chamber, such that the crankshaft 2 is arranged distal from the combustion chamber. The camshaft 6 can be rotatably supported by the crankcase cover 4*b* at an end of the camshaft 6 on one axial side thereof, namely, a lower end 6*d*. The camshaft 6 can be rotatably supported by the crankcase body 4*a* at an end of the camshaft 6 on the other axial side thereof, namely, an upper end 6*u*. The structure used to support the lower end of the camshaft 6 will be further explained later in detail.

The camshaft 6 is configured to be geared to the crankshaft 2. In particular, a driven gear 6*a* on the camshaft 6 is configured to be geared to a drive gear 2*a* on the crankshaft 2 in a manner capable of receiving rotary power that is transferred therefrom. Accordingly, the camshaft 6 is configured to interlockingly rotate with the crankshaft 2. The drive gear 2*a* on the crankshaft 2 and the driven gear 6*a* on the camshaft 6 may be arranged on the other axial side, i.e., an upper side, of a mating plane S between the crankcase body 4*a* and the crankcase cover 4*b*.

In other words, the drive gear 2*a* may be arranged on one axial side (namely, a lower side) of connecting rods and balance weights but on the other axial side (namely, an upper side) of a part P3 of the crankshaft 2 that is inserted in the crankcase cover 4*b*. Furthermore, the driven gear 6*a* may be arranged on one axial side (namely, a lower side) of sliding surfaces for the push rods but on the other axial side (namely, an upper side) of a pump cover 16 which will be further explained later.

In the present embodiment, the engine E includes a pump shaft 8 that is configured to interlockingly rotate with the crankshaft 2. In the present embodiment, the pump shaft 8 is coaxial to and of an inseparable one-piece construction with the camshaft 6. The pump shaft 8 extends from one axial side of the lower end of the camshaft 6; that is, the pump shaft 8 is designed to extend downwardly from the camshaft 6. Alternatively, the pump shaft 8 may be a distinct component from the camshaft 6. The crankshaft and the pump shaft may be collectively referred to as a multi-functional shaft.

Figure 2:
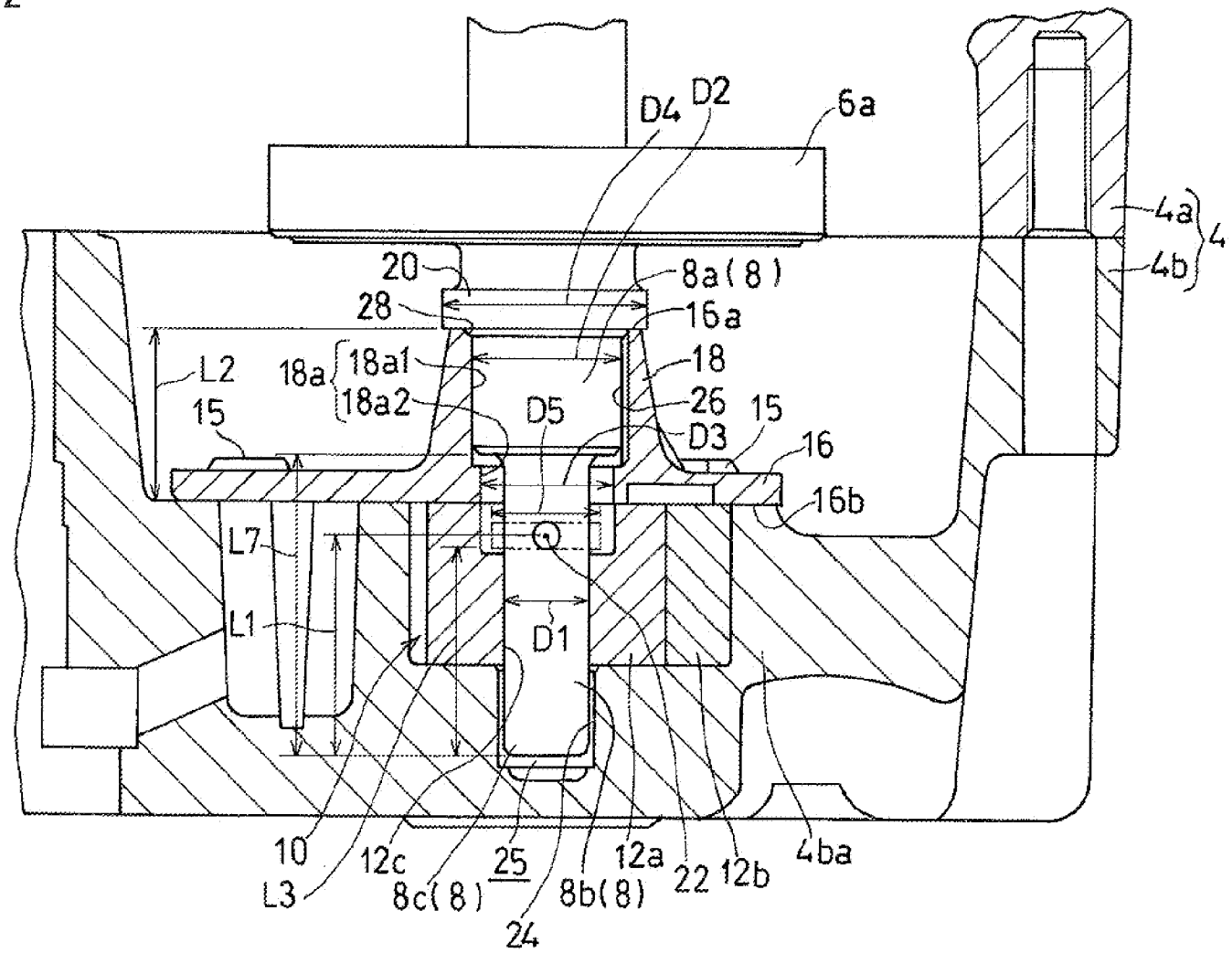
FIG. 2 shows a cross sectional view of said pump shaft support structure.

FIG. 2 includes a cross section of the pump shaft 8 on an enlarged scale. The pump shaft 8 is formed to have a cylindrical shape with a stepped feature in an axial direction. The pump shaft 8 includes a supported section 8*a* configured to be supported by the pump cover 16 and an insertion section 8*b* adjoining one axial side of the supported section 8*a*. The supported section 8*a* is formed to have a cylindrical shape defining an external shape that is uniform in an axial direction. Further, the insertion section 8*b* is formed to have a cylindrical shape defining an external shape that is uniform in an axial direction. In the present embodiment, the insertion section 8*b* is formed to have a diameter D1 smaller than a diameter D2 of the supported section 8*a*. The insertion section 8*b* is designed so as to extend downwardly contiguous to a lower end of the supported section 8*a*. The details of the pump shaft 8 are saved for later.

In the present embodiment, the pump shaft 8 serves as a shaft for a pump 10. Put differently, the pump shaft 8 is a shaft used to transfer mechanical power to a pump rotor 12. The insertion section 8*b* of the pump shaft 8 is configured for engagement with the pump rotor 12. In the present embodiment, the pump 10 is a pump configured to pump oil serving as a lubricant into the engine. The pump rotor 12 is configured for engagement with the pump shaft 8 and for fixed rotation therewith—therefore, for unitary rotation with the pump shaft 8. Rotation of the pump rotor 12 causes the pump to pump and feed the oil serving both as a lubricant and as a coolant to various parts of the engine.

In the present embodiment, the pump 10 is a trochoid pump. In particular, the pump rotor 12 is constructed of an inner rotor 12*a* provided with a plurality of convex segments defining a shape like petals on a flower and an outer rotor 12*b* provided with concave segments that are greater in number than the convex segments, in which the inner rotor 12*a* is fitted inside the outer rotor 12*b* such that the central axes of the inner rotor 12*a* and the outer rotor 12*b* are offset from each other. The rotors 12*a* and 12*b* can be rotatably received in a pump chamber 14 which will be further explained later. In particular, the insertion section 8*b* of the pump shaft 8 can be inserted into a hollow bore in the inner rotor 12*a* for engagement therewith, in such a way that brings an outer peripheral surface of the inner rotor 12*a* into engagement with an inner peripheral surface of the outer rotor 12*b*. When the inner rotor 12*a* is driven into rotation, those convex segments of the inner rotor 12*a* are in contact with corresponding concave segments of the outer rotor 12*b* so as to impart a rotary force to the outer rotor 12*b*. In this way, the outer rotor 12*b* can be brought into synchronous rotation with the inner rotor 12*a*. Due to a difference in number between the concave and convex segments of the rotors 12*a*, 12*b*, the volume of the gap between the rotors 12*a* and 12*b* will change during rotation. Expansion of the volume causes oil to be sucked in, and reduction of the volume forces out the oil, thus providing the function of a pump.

In the present embodiment, the pump chamber 14 for the pump 10 is defined by the crankcase cover 4*b* and the pump cover 16. The pump cover 16 can be detachably coupled to the crankcase cover 4*b* by means of fastener members 15 such as a bolt. More specifically, the crankcase cover 4*b* has a recess 4*ba* that is defined therein in a downwardly recessed manner. The pump cover 16 closes the recess 4*ba* in the crankcase cover 4*b* from above. Accordingly, the pump chamber 14 will be located downwards of the pump cover 16. The rotors 12*a* and 12*b* serving as the pump rotor 12 can be received in this pump chamber 14.

In the present embodiment, the pump cover 16 closing the pump chamber 14 includes a support structure to support the pump shaft 8. In particular, the pump cover 16 rotatably supports the pump shaft 8 that extends contiguous to one side of the camshaft 6 in an axial direction of the pump shaft 8. That is, the pump cover 16 rotatably supports an end-side segment of the multi-functional shaft—a shaft in which the camshaft 6 is incorporated with the pump shaft 8—on one side in an axial direction of the multi-functional shaft. In other words, the pump shaft 8 can be rotatably supported by the crankcase cover 4*b* through the pump cover 16. The pump cover 16 rotatably supports the supported section 8*a* of the pump shaft 8 on the other side of the pump chamber 14 from the crankcase cover 4*b*. It is to be noted that, as shown in FIG. 1, the camshaft 6 is supported by a camshaft bearing section P4 of the crankcase body 4*a* at the other end of the camshaft 6 in an axial direction, namely, at the upper end 6*u*. Thus, the camshaft 6 is supported by the crankcase body 4*a* and the crankcase cover 4*b* at one end and an opposite end of the camshaft 6, respectively.

In detail, as shown in FIG. 2, the pump cover 16 has a bearing section 18 with a cylindrical shape defining an axis that extends in a vertical direction. The bearing section 18 provides a plain bearing having an inner peripheral surface 18*b* on which the supported section 8*a* of the pump shaft 8 can slide. In other words, the inner peripheral surface 18*b* forms a bearing surface which also represents a sliding surface. The pump cover 16 has a through bore 18*a* comprising a hollow bore in the bearing section 18 and formed in the pump cover 16 so as to extend through the pump cover 16 in an axial direction of the pump shaft 8. The through bore 18*a* is formed of a first area 18*a*1 and a second area 18*a*2, such that the second area 18*a*2 is located on one side of the first area 18*a*1 and the first area 18*a*1 is located so as to face the other side in the axial direction of the pump shaft 8. The first area 18*a*1 defines a cylindrical space having a diameter D2 corresponding to the supported section 8*a* of the pump shaft 8. The second area 18*a*2 defines a cylindrical space having a diameter D3 smaller than the diameter D2 of the first area 18*a*1 and greater than the diameter D1 corresponding to the insertion section 8*b* of the pump shaft 8 (D2>D3>D1).

An axial length L1 of the insertion section 8*b* is greater than an axial length L2 of the through bore 18 (L1>L2). In particular, the axial length L1 of the insertion section 8*b* is an axial length measured from one end face of the insertion section 8*b* in the axial direction of the pump shaft 8 to the supported section. An axial length L3 measured from one end face of the insertion section 8*b* in the axial direction of the pump shaft 8 to protrusions 22 is greater than the axial length L2 of the through bore 18 (L3>L2). A length D5 defined by the protrusions 22 and measured along an imaginary plane P is set to be smaller than either one of the diameters D2 and D3 (D2>D5 and D3>D5). It is to be noted that, in the description that follows, the first area 18*a*1 may be referred to as a sliding surface 18*a*1 or a bearing surface 18*a*1.

The pump shaft 8 includes a flange section 20 which comes into abutment with an end face—in particular, a top end face—of the pump cover 16. The flange section 20 has a diameter D4 greater than the diameter D3 of the supported section 8*a* (D4>D3). Arranged below the driven gear 6*a* on the pump shaft 8 from the other end of the pump shaft 8 will be the flange section 20, the supported section 8*a*, and the insertion section 8*b* in this order from the top. The flange section 20, the supported section 8*a*, and the insertion section 8*b* are situated in the crankcase cover 4*b*.

The pump shaft 8 includes the protrusions 22 protruding radially from an outer peripheral surface of the insertion section 8*b*. The protrusions 22 engaged an inner peripheral surface of the inner rotor 12*a* for fixed rotation with the pump rotor 12. In the present embodiment, the protrusions 22 are defined by cylindrical pins protruding from an outer peripheral surface of the insertion section 8*b*. With respect to a radial direction, protruding ends of the protrusions 22 are situated radially inwards of the supported section 8*a* of the pump shaft 8. Put differently, the amount X1 of protrusion by each of the protrusions 22 from the insertion section 8*b* in a radial direction is selected to be smaller than the amount X2 (X2=(D2−D1)/2) of protrusion by the supported section 8*a* from the insertion section 8*b* in a radial direction (X2>X1). Moreover, the amount X1 of protrusion by each of the protrusions 22 in a radial direction is selected to be smaller than a distance ((D3−D1)/2) measured from the second area 18*a*2 of the through bore 18 to the insertion section 8*b* ((D3−D1)/2>X1).

Figure 3A:
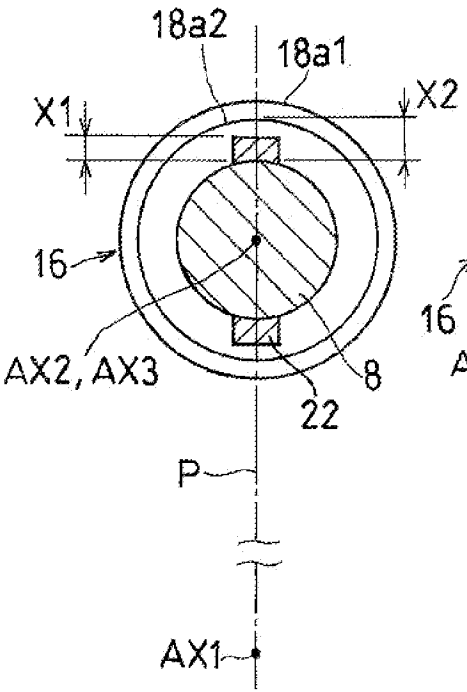
FIG. 3A shows a cross sectional view illustrating the relationship in position between a pump shaft and a pump cover.

In the present embodiment, as shown in FIG. 3A, there are two protrusions 22 spaced apart by 180 degrees in a circumferential direction. The two protrusions 22 protrude from the insertion section 8*b* in a direction that aligns with the imaginary plane P containing an axis of the crankshaft 2 and an axis of the pump shaft 8. Referring to FIG. 2, the axial length L1 measured between a free end face of the pump shaft 8 and the protrusions 22 is greater than the axial length L2 of the through bore 18 of the pump cover 16.

The insertion section 8*b* of the pump shaft 8 includes an extension 8*c* protruding from one side of the pump rotor 12 in the axial direction of the pump shaft 8 when the protrusions 22 are in engagement with the pump rotor 12.

The crankcase cover 4*b* has an accommodation space 24 which accommodates the extension 8*c* of the insertion section 8*b*. In particular, the crankcase cover 4*b* has a recess 24 that is defined in a bottom surface of the crankcase cover 4*b* so as to be recessed downwardly from the pump chamber 14 and merge with the pump chamber 14. The extension 8*c* of the pump shaft 8 can be inserted in the recess 24. Thus, the recess 24 defines said accommodation space 25.

Figure 5:
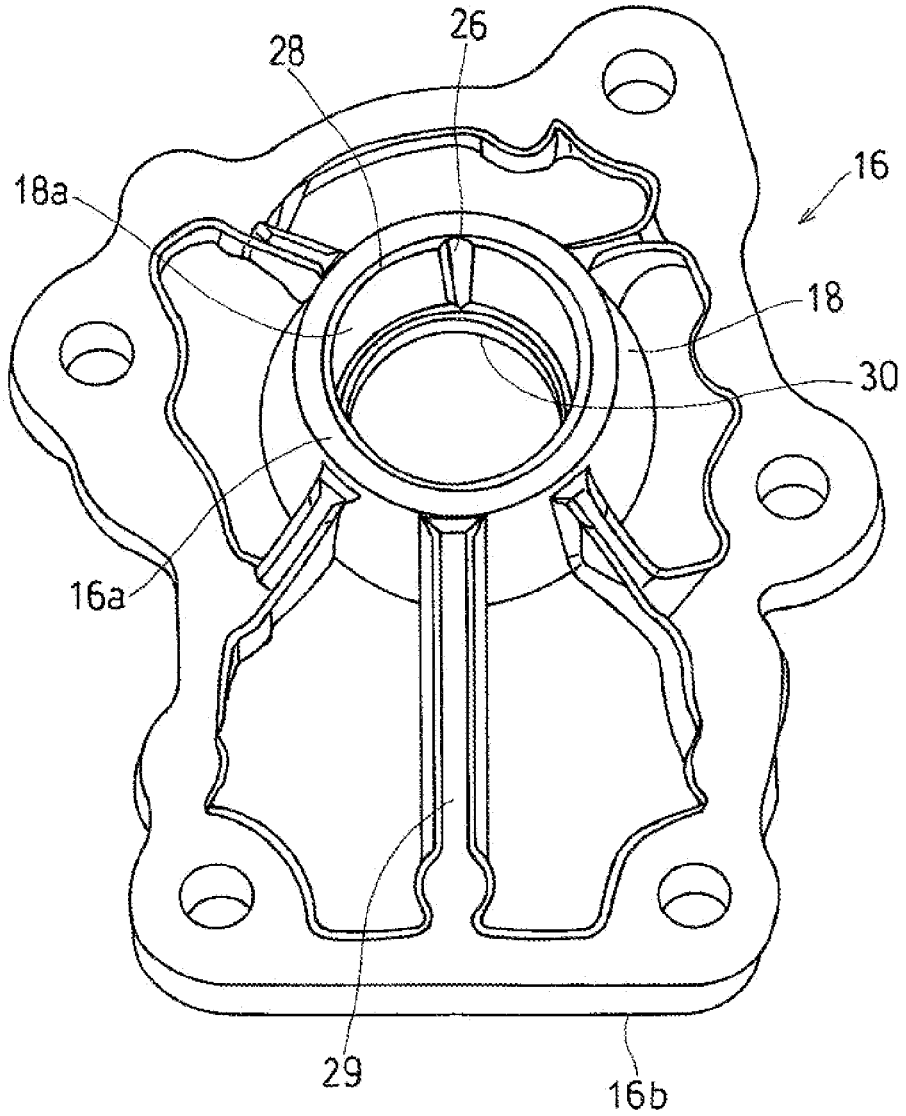
FIG. 5 shows a front elevational view of said pump cover of said engine.

As shown in FIG. 5, the pump cover 16 has a first oil passage 26 defined in an inner peripheral surface of the bearing section 18 of the pump cover 16. In the present embodiment, the first oil passage 26 is in the form of a channel defined in an inner peripheral surface of the bearing section 18 so as to extend in an axial direction, i.e., a vertical direction. The pump cover 16 also has a second oil passage 28 communicating with the first oil passage 26, in a top end face 16*a* of the pump cover 16 with which the flange section 20 (FIG. 2) comes into abutment. In the present embodiment, the second oil passage 28 is in the form of a channel defined in the top end face 16*a* of the pump cover 16 so as to extend in a circumferential direction and in communication with the first oil passage 26. The pump cover 16 is formed with a plurality of ribs 29. The ribs 29 extend radially from the bearing section 18 and are spaced apart from each other in a circumferential direction of the bearing section 18.

Further, the pump cover 16 has a bottom end face 16*b* with a discharge recess 30 communicating with the first oil passage 26. The discharge recess 30 is an indentation defined in the bottom end face 16*b*. The discharge recess 30 communicates with a high-pressure zone in the pump chamber 14 where the hydraulic pressure is elevated. The high-pressure zone connects to an outlet flow path for the oil compressed by rotations of the rotors in the pump chamber 14. Accordingly, a portion of the oil compressed by rotations of the rotors 12 can be pumped through the high-pressure zone in the pump chamber 14 and the discharge recess 30 into the first oil passage 26. Furthermore, the oil pumped into the first oil passage 26 can, in turn, be partially pumped into the second oil passage 28.

Referring to FIG. 1, upon the start of the engine E, the camshaft 6 and the pump shaft 8 interlockingly rotate with the crankshaft 2, forcing the oil in the pump chamber 14 to be fed to various parts of the engine E. Here, a portion of the oil is caused to flow through the discharge recess 30 in the bottom end face 16*b* of the pump cover 16 shown in FIG. 4 into the first and second oil passages 26 and 28 shown in FIG. 5. In this way, the sliding area between the bearing section 18 of the pump cover 16 and the pump shaft 8 as well as the abutment area between the flange section 20 of the pump shaft 8 and the top end face 16*a* of the pump cover 16 can be lubricated.

As shown in FIG. 1, a distance L4 measured from the mating plane S to the initial point of the crankshaft 2 at which the crankshaft 2 is situated inside a through bore in the crankcase cover 4*b* is greater than a distance L5 measured from the mating plane S to an end face of the insertion section 8*b* on one axial side thereof. The distance L4 measured from the mating plane S to the initial point of the crankshaft 2 at which the crankshaft 2 is situated inside the through bore in the crankcase cover 4*b* is greater than a distance L6 measured from the mating plane S to ends of the protrusions 22 in the axial direction of the pump shaft 8.

As shown in FIG. 3A, the protrusions 22 are formed on a prismatic bar member. In the present embodiment, the protrusions 22 are formed to have a rectangular cross section. As such, the protrusions 22 could easily damage the sliding surface when they inadvertently hit the sliding surface. The corners on the protrusions 22 may be edge-treated. The protrusions 22 have radii of curvature that can be smaller than that of the insertion section 8*b*, even after such an edge treatment.

The process of mounting the pump shaft 8 to the crankcase 4 according to the present embodiment will be described in connection with FIG. 1 and FIGS. 6 to 10.

Figure 6:
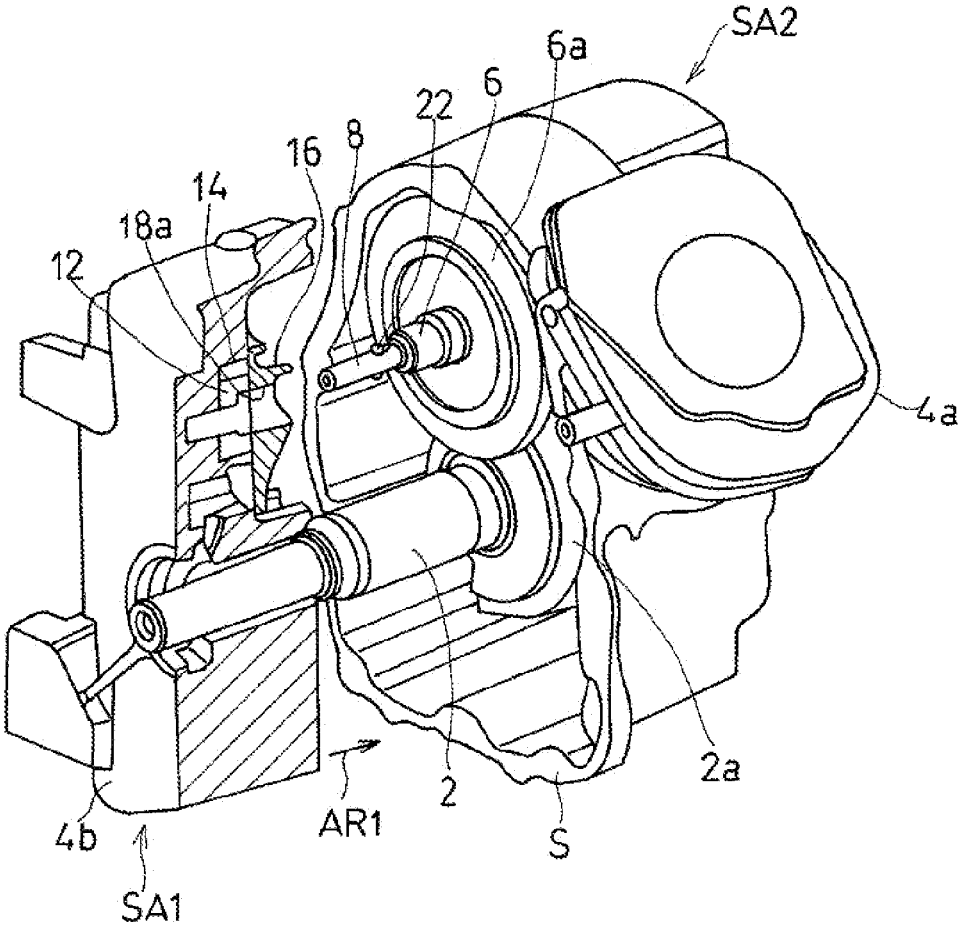
FIG. 6 shows a perspective view illustrating the mounting procedure of said pump shaft to a crankcase.

Firstly, a cover-side subassembly SA1 shown in FIG. 6 is assembled. More specifically, the pump rotor 12 is received in the pump chamber 14 of the crankcase cover 4*b*. Then, the pump cover 16 is coupled to the crankcase cover 4*b* by means of the fastener members 15 (FIG. 2). In this way, the cover-side subassembly SA1 containing the pump rotor 12, the crankcase cover 4*b*, and the pump cover 16 is constructed.

Then, a case-side subassembly SA2 is assembled. More specifically, the crankshaft 2 and the camshaft 6 are arranged such that they are supported, at outer ends of the crankshaft 2 and the camshaft 6 in an axial direction, by the crankcase body 4*a*. In so doing, the drive gear 2*a* on the crankshaft 2 and the driven gear 6*a* on the camshaft 6 are positioned so as to mesh each other in a predetermined meshing position. In this way, the case-side subassembly SA2 containing the crankshaft 2, the camshaft 6, and the crankcase body 4*a* is constructed. Preferably, the protrusions 22 and the meshing position are arranged such that the protrusions 22 align with the imaginary plane P (FIG. 3A) when the camshaft 6 is in meshing engagement in said predetermined meshing position.

As shown in FIG. 6, with the two subassemblies Sal and SA2 being each assembled, the cover-side subassembly SA1 can be moved in a direction indicated with an arrow AR1 towards the case-side subassembly SA2. In the case-side subassembly SA2, the crankshaft 2 and the pump shaft 8 are protruding from one side of the crankcase body 4*a* in the axial direction of the pump shaft 8 relative to the mating plane S. Referring to FIG. 1, the distance L4 is greater than either one of the distance L5 and the distance L6, as mentioned earlier. Therefore, as illustrated in FIG. 6, one end of the crankshaft 2 in an axial direction is inserted into the crankcase cover 4*b* before one end of the pump shaft 8 in an axial direction is inserted into the crankcase cover 4*b*. That is, at this point, said one end of the pump shaft 8 in an axial direction is not yet inserted into the through bore 18*a* in the pump cover 16.

Figure 7:
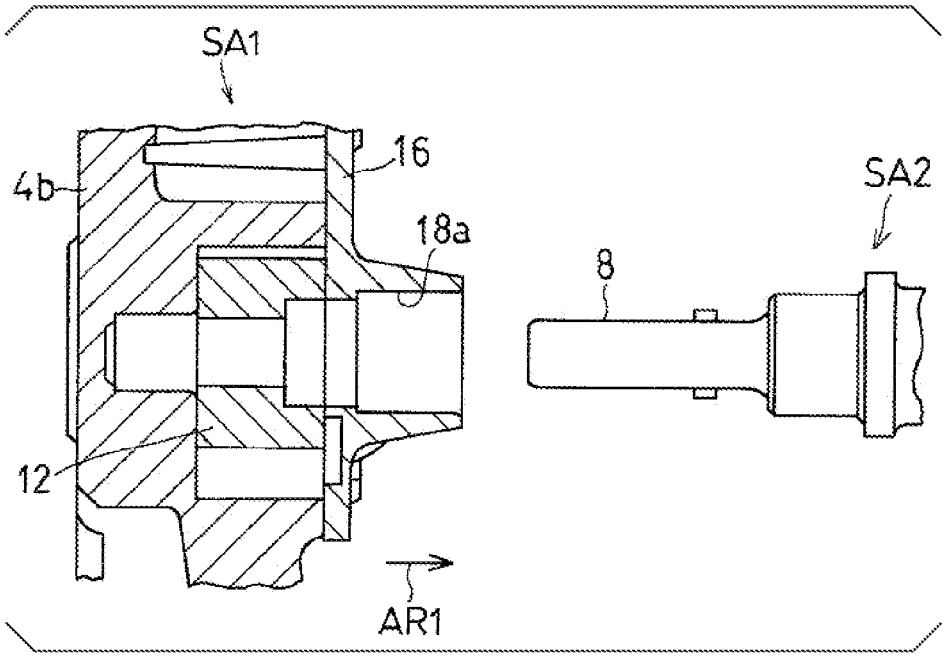
FIG. 7 shows a cross sectional view illustrating the mounting procedure of said pump shaft to said crankcase.

Insertion of the crankshaft 2 into the crankcase cover 4*b* in this manner causes the two subassemblies Sal and SA2 to be aligned with each other along an axis of the crankshaft 2. With the relative displacement between the subassemblies SA1, SA2 being restricted in this manner, the cover-side subassembly SA1 can be moved in an axial direction (namely, a direction indicated with the arrow AR1) towards the case-side subassembly SA2 so as to reach the arrangement of FIG. 7. In the arrangement of FIG. 7, said one end of the pump shaft 8 in an axial direction is located in a position to face the through bore 18*a* in the pump cover 16 with a gap therebetween. Thus, said one end of the pump shaft 8 in an axial direction is not yet inserted into the through bore 18*a* in the pump cover 16.

Figure 8:
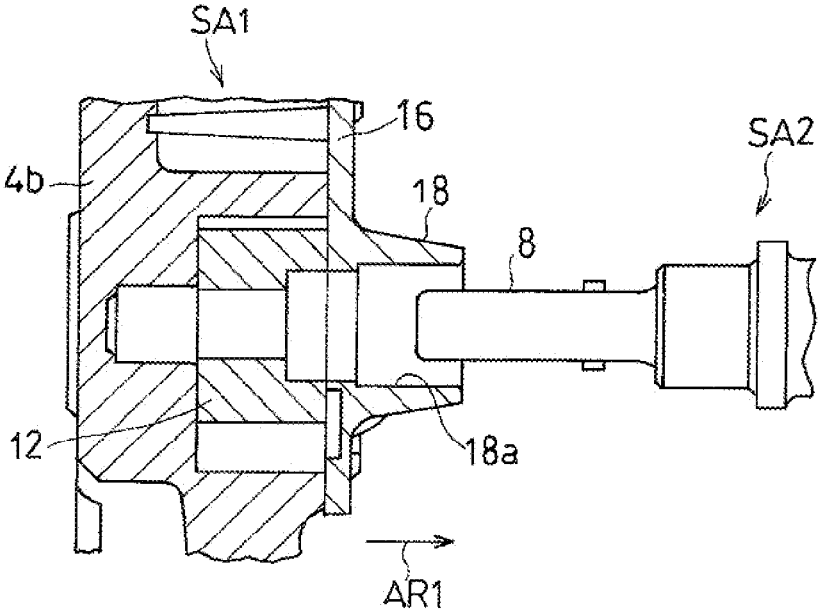
FIG. 8 shows another cross sectional view illustrating the mounting procedure of said pump shaft to said crankcase.

The cover-side subassembly SA1 can be further moved in an axial direction (namely, a direction indicated with the arrow AR1) towards the case-side subassembly SA2 so as to reach the arrangement of FIG. 8. In the arrangement of FIG. 8, said one end of the pump shaft 8 in an axial direction, namely, a free end thereof, is inserted into the through bore 18*a* in the pump cover 16. In the process, a relative displacement therebetween is restricted due to the preceding insertion of the crankshaft 2. Further, the free end of the pump shaft 8 has a diameter smaller than a diameter of the bearing section 18 of the pump cover 16. As such, the free end of the pump shaft 8 can be prevented from hitting the sliding surface of the pump cover 16.

Figure 9:
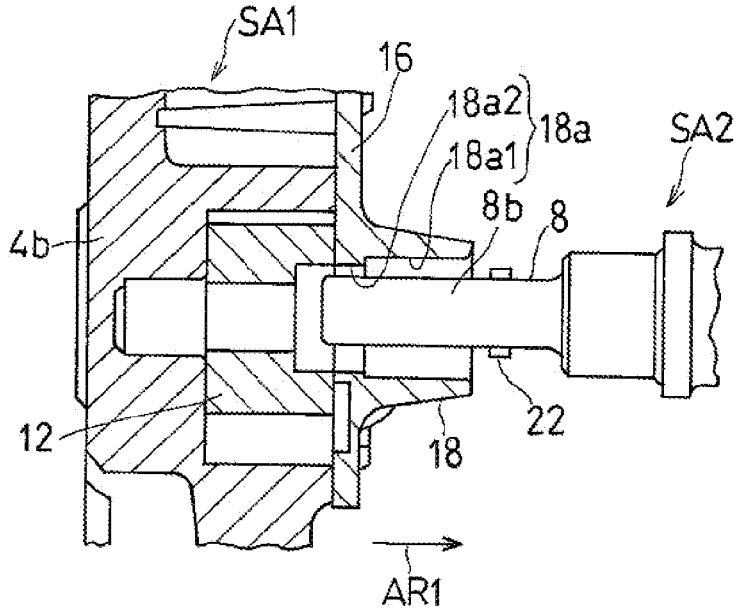
FIG. 9 shows yet another cross sectional view illustrating the mounting procedure of said pump shaft to said crankcase.

The cover-side subassembly SA1 can be further moved in an axial direction (namely, a direction indicated with the arrow AR1) towards the case-side subassembly SA2 so as to reach the arrangement of FIG. 9. In the arrangement of FIG. 9, the insertion section 8*b* of the pump shaft 8 is inserted into the through bore 18*a* in the bearing section 18 of the pump cover 16. The protrusions 22 on the pump shaft 8 are distally spaced apart from one other side (upper side) of the sliding surface of the bearing section 18 in the axial direction of the pump shaft 8 and are therefore not yet inserted into the through bore 18*a*. Furthermore, referring to FIG. 2, since the axial length L3 measured from one end face of the insertion section 8*b* in the axial direction of the pump shaft 8 to the protrusions 22 is greater than the axial length L2 of the through bore 18 (L3>L2), the insertion section 8*b* of the pump shaft 8 enters the smaller-diameter, second area 18*a*2 of the through bore 18*a* before the protrusions 22 thereon are inserted into the through bore 18*a*. In this way, the cover-side subassembly SA1 can be guided by the pump shaft 8 in such a way that suppresses misalignment of the cover-side subassembly SA1 relative to the case-side subassembly SA2 about an axis of the crankshaft 2. Put in different terms, misalignment can be suppressed between the pump cover 16 and the pump shaft 8.

Figure 10:
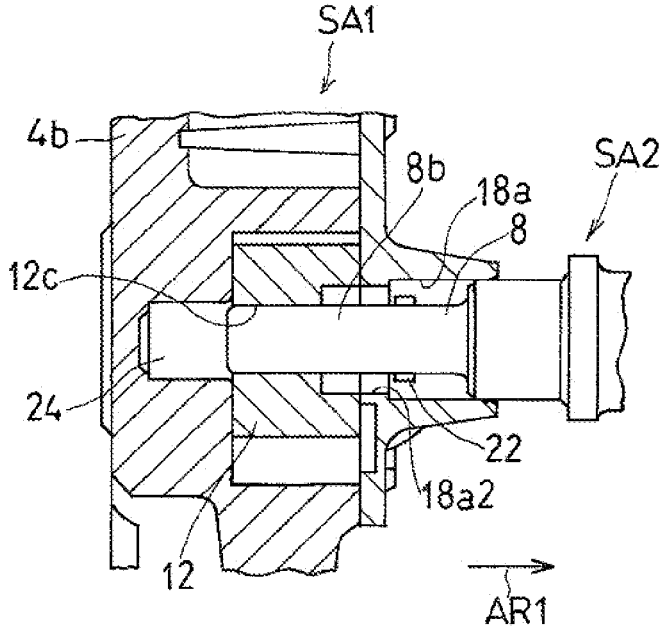
FIG. 10 shows yet another cross sectional view illustrating the mounting procedure of said pump shaft to said crankcase.

The cover-side subassembly SA1 can be further moved in an axial direction (namely, a direction indicated with the arrow AR1) towards the case-side subassembly SA2 so as to reach the arrangement of FIG. 10. In the arrangement of FIG. 10, the insertion section 8*b* of the pump shaft 8 is inserted into the hollow bore 12*c* in the pump rotor 12 while the protrusions 22 are positioned in the through bore 18*a*. Such guidance of the insertion section 8*b* of the pump shaft 8 by the hollow bore 12*c* in the pump rotor 12 can restrict displacement thereof in a radial direction, thereby preventing the protrusions 22 from hitting the bearing surface.

In this process, there is a possibility that the pump shaft 8 makes a pivoting movement about an axis of the crankshaft 2 relative to the cover-side subassembly SAL As described above, when the case-side subassembly SA2 is assembled, the protrusions 22 are oriented in the top-to-bottom direction of FIG. 3A—i.e., are adjusted so as not to be oriented in the lateral direction (namely, a pivoting direction) of FIG. 3A—with the aid of alignment marks. This can prevent the protrusions 22 from hitting an inner peripheral surface, namely, the bearing surface, of the through bore 18*a* in the bearing section 18, since the pump shaft 8 can only pivot in the pivoting direction.

Moreover, in the arrangement of FIG. 10, one end face of the insertion section 8*b* of the pump shaft 8 in the axial direction of the pump shaft 8 is exposed from the hollow bore 12*c* in the pump rotor 12, thereby moving the extension 8*c* of the pump shaft 8 into the accommodation space 24 in the crankcase cover 4*b*. Further, the supported section 8*a* of the pump shaft 8 starts to fit into the through bore 18*a* in the bearing section 18 of the pump cover 16 while the protrusions 22 on the pump shaft 8 are positioned in the through bore 18*a*. Furthermore, misalignment between the rotatably supportable section and the sliding surface can be suppressed due to the fact that the axial length L1 of the insertion section 18*a* is greater than the axial length L2 of the through bore 18 (L1>L2).

At this point, the fitting of the supported section 8*a* of the pump shaft 8 into the through bore 18*a* which forms the bearing surface of the bearing section 18 prevents displacement of the pump shaft 8 in a radial direction, thereby keeping the protrusions 22 from hitting the bearing surface 18*a* or the second area 18*a*2. By keeping the protrusions 22 from hitting the second area 18*a*2, possible generation of chips upon contact therewith can be prevented, thereby avoiding a failure such as biting of the chips into the sliding surface. Furthermore, the entrance and guidance of the extension 8*c* of the pump shaft 8 into the accommodation space 24 in the crankcase cover 4*b* facilitates a more stable movement of the subassembly.

The cover-side subassembly SA1 in the arrangement of FIG. 10 can be further moved in an axial direction (namely, a direction indicated with the arrow AR1) towards the crankcase body 4*a* so as to reach the assembly complete state of FIG. 2. In FIG. 2, the entire supported section 8*a* of the pump shaft 8 is fitted to the first part 18*a*1 of the through bore 18*a*— that is, the sliding surface—of the bearing section 18. Further, the flange section 20 of the pump shaft 8 is in abutment with the end face 16*a* of the pump cover 16. Furthermore, the protrusions 22 on the pump shaft 8 are in engagement with the pump rotor 12. As a result, rotation of the pump shaft 8 leads to rotation of the pump rotor 12 and can force oil to be fed to various parts.

As can be understood from the above, the crankcase cover 4*b* forms a pump shaft support which supports the pump shaft 8. In addition, the crankcase cover 4*b* serving as the pump shaft support also supports the crankshaft 2 which is an additional shaft different from the pump shaft 8. The pump shaft 8 can be inserted into the crankcase cover 4*b* while the crankshaft 2 serving as the additional shaft is in retaining engagement with the crankcase cover 4*b*.

In the abovementioned construction, the pump cover 16 is used to support the pump shaft 8. This allows the pump cover 16 to serve both as an element that supports the pump shaft 8 and as an element that defines the pump chamber 14. Accordingly, the pump shaft support structure in the present embodiment requires a fewer number of parts, as compared to the case in which the supporting element and the pump chamber defining element are constructed as different elements. Further, the pump shaft 8 is an integrally formed unit of the supported section 8*a* to be rotatably supported and a section configured for engagement with the pump rotor 12. More specifically, the pump shaft 8 can be implemented by a single shaft. Such a configuration allows for a simple structure of the pump shaft 8, as compared to a configuration in which the supported section 8*a* couples to the rotor engaging section. Also, with no such coupling step for the pump shaft 8 required, a mounting process therefor can be simplified.

In the aforementioned configuration, the insertion section 8*b* of the pump shaft 8 has a diameter smaller than a diameter of the supported section 8*a*. An inner diameter of the bearing section 18 of the pump cover 16 is substantially identical to the diameter D2 of the supported section 8*a*. Hence, the diameter D1 of the insertion section 8*b* is designed to be smaller than an inner diameter of the bearing section of the pump cover 16. This makes it easy for the insertion section 8*b* of the pump shaft 8 to be inserted into and pass through the bearing section 18 of the pump cover 16 by providing and maintaining a radial gap therebetween. Hence, it can keep the insertion section 8*b* of the pump shaft 8 from hitting the bearing surface 18*a*1 (i.e., the sliding surface) of the pump cover 16 when inserting the insertion section 8*b* of the pump shaft 8 through the pump cover 16 during as assembly operation. Thus, the occurrence of a contact damage on the sliding surface of the bearing section 18 of the pump cover 16 caused by the hitting of the insertion section 8*b* of the pump shaft 8 can be mitigated. Therefore, possible sliding problem can be avoided.

An axial length L7 measured between the free end face of the pump shaft 8 and the supported section 8*a* is greater than the axial length L2 of the through bore 18*a* in the pump cover 16. Put differently, the axial length L7 measured from one end face of the insertion section 8*b* in the axial direction of the pump shaft 8 to the supported section 8*a* is greater than the axial length L2 of the through bore 18*a*. This can prevent the supported section 8*a* from entering the bearing section 18 of the pump cover 16 before the free end of the pump shaft 8 enters into the pump rotor 12.

During the insertion of the pump shaft 8 into the pump cover 16, the free end face of the pump shaft 8 passes through the through bore 18 and enters the pump rotor 12 before the supported section 8*a* enters into the bearing section 18. Thus, the insertion of the supported section 8*a* into the pump cover 16 takes place after the free end of the pump shaft 8 is inserted into the pump rotor 12 and positions the pump shaft 8 in proper alignment. In other words, the pump shaft 8 can be aligned approximately to a center of the through bore 18*a* in advance before the insertion of the supported section 8*a* into the pump cover 16 takes place.

Accordingly, the supported section 8*a* can be prevented from hitting the bearing surface 18*a*1 of the pump cover 16. Thus, the occurrence of a contact damage on the sliding surface of the bearing section of the pump cover 16 caused by the hitting of the supported section 8*a* of the pump shaft 8 can be mitigated. Therefore, possible sliding problem can be avoided.

The pump shaft 8 includes the protrusions 22 on the insertion section 8*b* thereof. The axial length L3 measured between the free end face of the pump shaft 8 and the protrusions 22 is greater than the axial length L2 of the through bore 18*a* in the pump cover 16. In other words, the axial length L3 measured from one end face of the insertion section 8*b* in the axial direction of the pump shaft 8 to the protrusions 22 is greater than the axial length L2 of the through bore 18*a*. Moreover, preferably, the axial length L3 measured from one end face of the insertion section 8*b* in the axial direction of the pump shaft 8 to the protrusions 22 is greater than an axial length of the sliding surface 18*a*1 of the pump cover 16.

Consequently, the insertion of the protrusions 22 into the pump cover 16 takes place after the free end of the pump shaft 8 is inserted into the pump rotor 12 and positions the pump shaft 8 in proper alignment. In other words, the pump shaft 8 can be aligned approximately to the center of the through bore 18*a* in advance before the insertion of the protrusions 22 into the pump cover 16 takes place. Accordingly, the protrusions 22 can be prevented from hitting the bearing surface 18*a*1 of the pump cover 16. Thus, the occurrence of a contact damage on the sliding surface of the bearing section of the pump cover 16 caused by the hitting of the protrusions 22 on the pump shaft 8 can be mitigated. Therefore, possible sliding problem can be avoided.

The pump shaft 8 includes the extension 8*c* which protrudes from the pump rotor 12 in an axial direction when the protrusions 22 are in engagement with the pump rotor 12, and the crankcase cover 4*b* includes the accommodation space 24 defined therein to accommodate the extension 8*c*. This makes it easy to extend the axial length of the insertion section 8*b* by allowing for an increase in a length of the pump shaft 8, as compared to the case in which the accommodation space 24 is not formed. As mentioned earlier, this provides a simple approach to increasing the axial length L7 measured from the free end of the pump shaft 8 to the supported section 8*a* and the axial length L1 measured from said free end to the protrusions 22. As a result, the supported section 8*a* and the protrusions 22 can be prevented from hitting the sliding surface of the pump cover 16 during the insertion of the pump shaft 8 through the pump cover 16, while increasing of the dimension of the pump chamber 14 in an axial direction can be suppressed.

The through bore 18*a* includes the first area 18*a*1 having a diameter corresponding to the supported section 8*a* of the pump shaft 8 and the second area 18*a*2 having a diameter smaller than the diameter of the first area 18*a*1 and greater than the diameter of the insertion section 8*b* of the pump shaft 8. Such a configuration allows a section of the pump cover 16 which is adjacent the second area 18*a*2 to guide the insertion section 8*b* of the pump shaft 8 into approximate alignment with the bore in the pump rotor 12, in advance before the insertion of the pump shaft 8 into the pump rotor 12 occurs. This promotes the pump shaft 8 to be easily inserted into the pump rotor 12.

The crankshaft 2 and the pump shaft 8 form an assembly which is supported by the crankcase 4. Then, the crankcase cover 4*b* with the pump cover 16 coupled thereto can be coupled to the crankcase body 4*a*. A distance that a free end of the crankshaft 2 has to traverse to reach an insertion bore in the crankcase cover 4*b* is shorter than a distance that the free end of the pump shaft 8 has to traverse to reach the through bore 18 in the pump cover 16. This allows the crankshaft 2 to be brought closer to the insertion bore in the crankcase cover 4*b* before the pump shaft 8 reaches the through bore 18 in the pump cover 8. Accordingly, the insertion of the pump shaft 8 into the crankcase cover 4 can be performed while the crankshaft 2 is kept in an inserted state through the insertion bore in the crankcase cover 4*b*.

In this way, it is possible to bring the pump shaft 8 closer to the pump cover 16 while suppressing misalignment between the pump shaft 8 and the crankcase cover 4*b* with the aid of the crankshaft 2. This can prevent possible large misalignment of the pump shaft 8 relative to the pump cover 16. Thus, the pump shaft 8 can be further reliably prevented from hitting the sliding surface of the pump cover 16.

There is still a possibility that misalignment occurs about an axis of the crankshaft 2, as mentioned earlier, despite the crankshaft 2 being in an inserted state through the crankcase cover 4*b* and thus constraining the crankcase cover 4*b* to the crankshaft 2. As shown in FIG. 3A, the protrusions 22 protrude in a direction that aligns with the imaginary plane P containing the axis AX1 of the crankshaft 2 and the axis AX2 of the pump shaft 8. Even if misalignment of the crankcase cover 4*b* occurs about the axis of the crankshaft 2, the protrusions 22 can be prevented from encroaching on the sliding surface of the pump cover 16 thanks to the alignment of the protrusions 22 with the imaginary plane P, as discussed earlier. In this way, the protrusions 22 can be prevented from hitting the bearing surface 18*a*1.

Figure 3B:
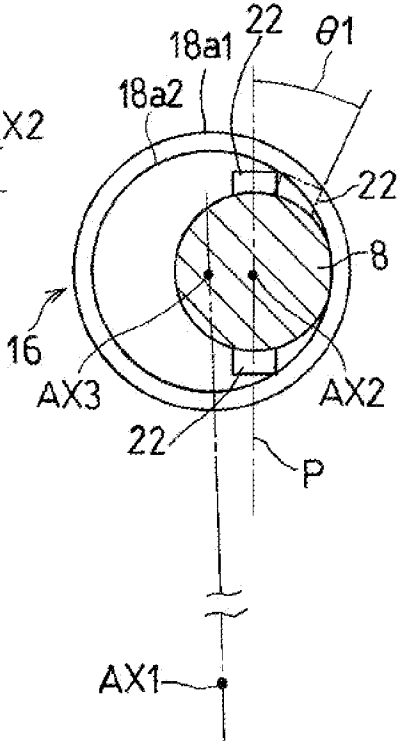
FIG. 3B shows a cross sectional view illustrating the relationship in position between said pump shaft and said pump cover, in a different state.
Figure 3C:
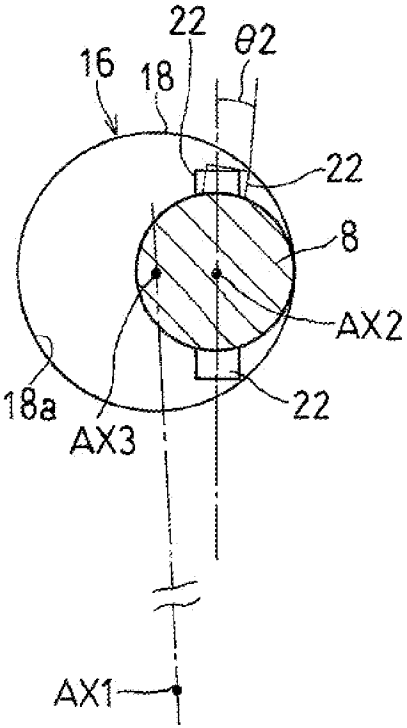
FIG. 3C shows a cross sectional view illustrating the relationship in position between a pump shaft and a pump cover, in accordance with a comparative example.

Specifically, even in the event of misalignment of an axis AX3 of the pump cover 16 and the axis AX2 of the pump shaft 8 during the installation of the pump cover 4*b* as shown in FIG. 3B, the protrusions 22 do not hit the sliding surface 18*a*1 thanks to the fact that the protrusions 22 are aligned with the imaginary plane P. Further, referring to FIG. 3B, a considerable tolerance margin (angle θ1) for possible angular offset of the protrusions 22 is also obtained. In FIG. 3C which illustrates a comparative example with no stepped feature in the through bore 18*a*, a tolerance margin (angle θ2) present for such a possible angular offset is smaller, as compared to that in FIG. 3B.

Figure 4:
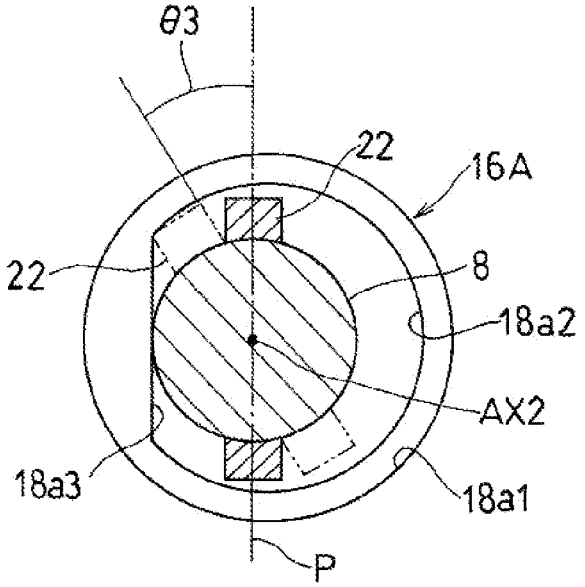
FIG. 4 shows a cross sectional view illustrating the relationship in position between said pump shaft and a pump cover that is designed according to an alternative variant.

FIG. 4 illustrates an alternative variant of the pump cover 16. A pump cover 16A of FIG. 4 differs from the present embodiment in the shape of a cross section of the second area 18*a*2 of the through bore 18*a*. In particular, the second area 18*a*2 is formed to include a flat end portion 18*a*3 extending so as to be aligned parallel to the imaginary plane P. In this way, a larger tolerance margin (angle θ3) for possible angular offset of the protrusions 22 can be obtained.

As shown in FIG. 5, the pump cover 16 includes the first lubricant passage 26 defined in an inner peripheral surface of the bearing section 18 of the pump cover 16. Consequently, the bearing section 18 can be lubricated with a lubricant pumped from the pump chamber 14.

As shown in FIG. 2, the pump shaft 8 includes the flange section 20 which comes into abutment with the end face 16*a* of the pump cover 16. The pump shaft 8 can be positioned in an axial direction relative to the pump cover 16 by bringing the flange section 20 into abutment with the end face 16*a* of the pump cover 16. In this way, the pump cover 16 can receive an axial load of the pump shaft 8 at a site of the pump cover 16 that is different from the bearing section 18 and can therefore alleviate the axial loading which the bearing section 18 may experience.

The pump cover 16 includes the second lubricant passage 28 defined in a face of the pump cover 16 with which the flange section 20 comes into abutment. As a result, such an abutment surface with which the flange section 20 comes into abutment can be lubricated with the lubricant pumped from the pump chamber 14. In this way, even in the event of increase in the axial loading to which the abutment surface may be subjected, wear between the flange section 20 and the pump cover 16 can be suppressed.

The pump shaft 8 extends in a vertical direction such that the pump chamber 14 is located downwards of the pump cover 16. In this way, the pump chamber 14 can be situated at a lower height than the pump shaft 8, thereby facilitating the provision of the pump chamber 14 below a lubricant level provided within the engine case 4. Due to the extension of the pump shaft 8 in a vertical direction, the axial loading which the pump cover 16 may experience tends to get bigger. By forming the lubricant passage(s) 26 and/or 28, however, suppression of wear can be suitably achieved using the lubricant.

The pump shaft 8 is coaxial to and of one-piece construction with the camshaft 6, and the camshaft 6 is supported by the crankcase body 4*a* at one end of the camshaft 6 which faces away from the pump shaft 8 and is supported by the crankcase cover 4*b* at a lower part of the camshaft 6 through the pump cover 16. According to this configuration, improved support and rigidity of the camshaft 6 can be achieved by enabling the camshaft 6 to be supported at a portion of the camshaft 6 that is in more proximity to valve driving elements provided on the camshaft 6, as compared to the case in which the opposite ends of the camshaft 6 are supported by the crankcase 4.

By designing the pump shaft 8 and the camshaft 6 to be of one-piece construction, the pump chamber 14 can be arranged below the mating plane S between the crankcase body 4*a* and the crankcase cover 4*b*, thereby making it easy to immerse the pump rotor 12 in the lubricant.

By designing the pump shaft 8 and the camshaft 6 to be of one-piece construction, the pump shaft 8 forms a component of the case-side subassembly SA2 to which the crankshaft 2 is assembled as well. After the assembly of such a case-side subassembly SA2 is complete, the aforementioned cover-side subassembly SA1 is then assembled to the case-side subassembly SA2. In so doing, there is a possibility that a relative displacement of the pump shaft 8 with respect to the cover-side subassembly SA1 may occur in a direction perpendicular to an axial direction.

As noted, in the aforementioned embodiment, the insertion section 8*b* of the pump shaft 8 has a diameter smaller than the diameter of the supported section 8*a*. This can help keep the insertion section 8*b* from hitting the sliding surface of the bearing section 18 of the pump cover 16 and therefore from damaging the bearing surface thereof. It can also help keep the protrusions 22 from hitting the sliding surface of the bearing section 18 of the pump cover 16 and therefore from damaging the bearing surface thereof.

Figure 11:
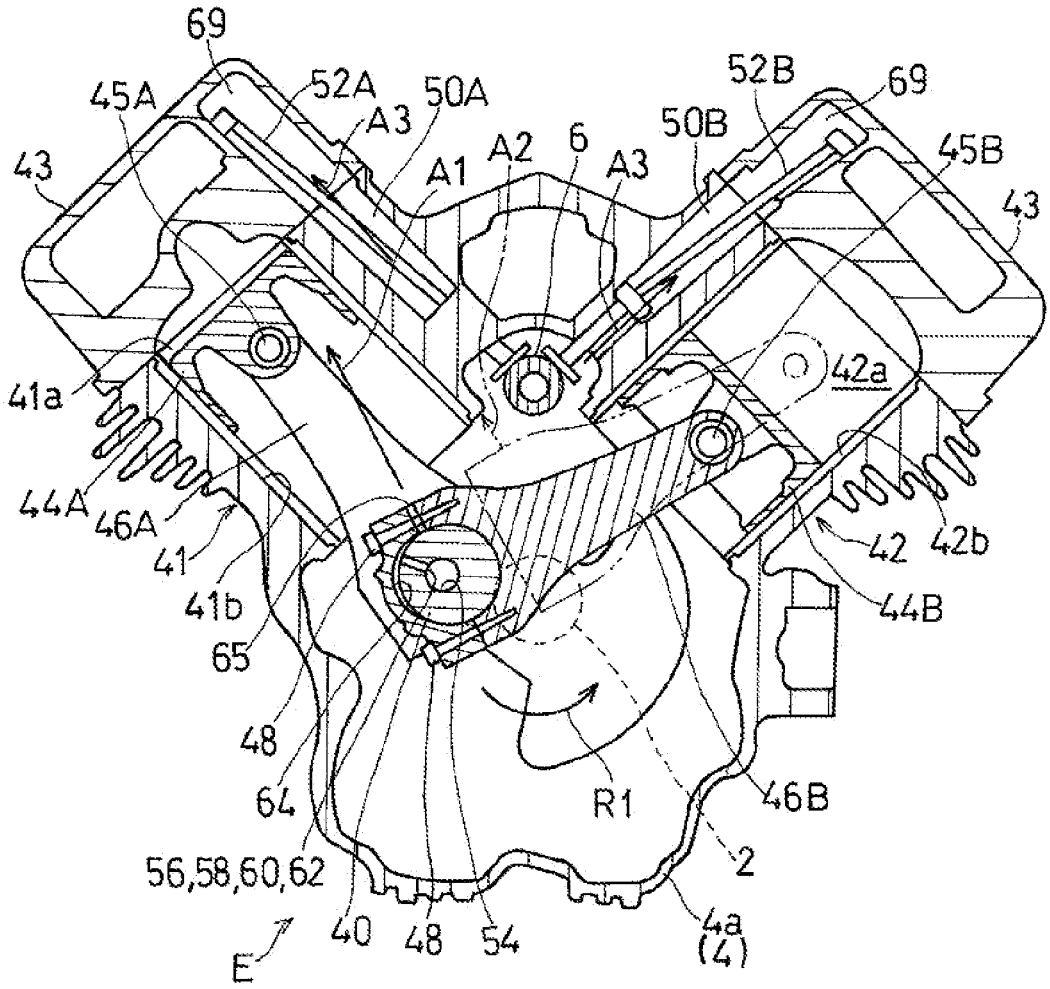
FIG. 11 shows a horizontal cross sectional view of said engine.

The mechanism used to produce and deliver an oil jet to cams will be described. As shown in FIG. 1, the crankshaft 2 includes a crankpin 40 at a site of the crankshaft 2 that is offset from an axis of the crankshaft 2. Meanwhile, as shown in FIG. 11, the engine E includes cylinders 41 and 42, in the interiors of which combustion chambers 41*a* and 42*a* are defined. The cylinders 41 and 42 can be coupled to the crankcase 4 in a manner that protrudes from the crankcase 4. In the present embodiment, the cylinders 41 and 42 are configured as a one-piece unit with the crankcase body 4*a*. Also, in the present embodiment, the left cylinder 41 and the right cylinder 42 on the sheet of FIG. 11 are No. 1 cylinder 41 and No. 2 cylinder 42, respectively. A cylinder head 43 can be mounted to a protruding end of each of the cylinders 41 and 42.

The cylinders 41 and 42 include pistons 44A and 44B which reciprocate in an axial direction in cylinder bores 41*b* and 42*b* defined in the interiors of the cylinders 41 and 42. The crankpin 40 and the pistons 44A and 44B can be coupled to each other by means of connecting rods 46A and 46B. In particular, a big end of each of the connecting rods 46A and 46B is split into two parts in a circumferential direction, such that the split parts can be fastened to each other using bolts 48 with the crankpin 40 interposed therebetween. Gudgeon pins or piston pins 45A and 45B can be mounted to the pistons 44A and 44B, and small ends of the connecting rods 46A and 46B can be attached to the piston pins 45A and 45B. In this way, reciprocating motions of the pistons 44A and 44B can be converted into a rotary motion of the crankshaft 2.

Further, the cylinders 41 and 42 are provided with rod passages 50A and 50B extending along axes of the cylinder bores 41*b* and 42*b*, and the push rods 52A and 52B are disposed in the rod passages 50A and 50B. Each of the push rods 52A and 52B has one end that is in contact with the camshaft 6 and an opposite end that is coupled via a rocker arm (not shown) to the intake and exhaust valves. That is, the push rods 52A and 52B are configured to transfer mechanical power from the camshaft 6 to the intake and exhaust valves. The rocker arm can be disposed in a rocker chamber 69 of each cylinder head 43.

As shown in FIG. 1, the crankpin 40 includes an oil passage 54 defined in the interior thereof. The oil passage 54 extends along an axial direction of the crankshaft 2. For example, oil can be delivered to the oil passage 54 from the aforementioned oil pump 10.

The crankpin 40 also has a plurality of oil holes 56, 58, 60, and 62 extending radially outwards from the oil passage 54. Each of the oil holes 56, 58, 60, and 62 has one end that is open to the oil passage 54 and an opposite end that is open to an outer peripheral surface of the crankpin 40.

First and second oil holes 56 and 58 are open to a region that is occupied by an interior circumferential surface formed in the connecting rod 46A for the No. 1 cylinder 41 shown in FIG. 11. Meanwhile, third and fourth oil holes 60 and 62 shown in FIG. 1 are open to a region that is occupied by an interior circumferential surface formed in the connecting rod 46B for the No. 2 cylinder 42 shown in FIG. 11.

Figure 12:
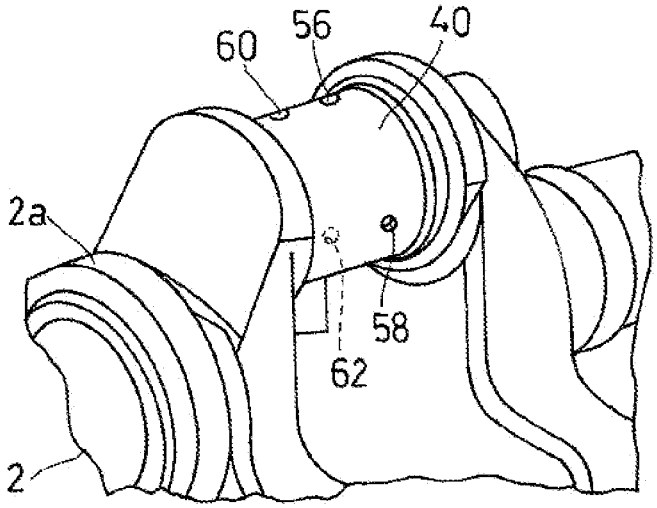
FIG. 12 shows a perspective view of a crankpin on a crankshaft of said engine.

As shown in FIG. 12, the first and third oil holes 56 and 60 are open at substantially identical positions in a circumferential direction on the crankpin 40. Alternatively, the first and third oil holes 56 and 60 may be open at different positions in a circumferential direction on the crankpin 40. The second oil hole 58 is open at a position that is different from those of the first and third oil holes 56 and 60 in a circumferential direction on the crankpin 40. The fourth oil hole 62 is open at a position that is different from those of the first to third oil holes 56, 58, and 60 in a circumferential direction on the crankpin 40.

Figure 13:
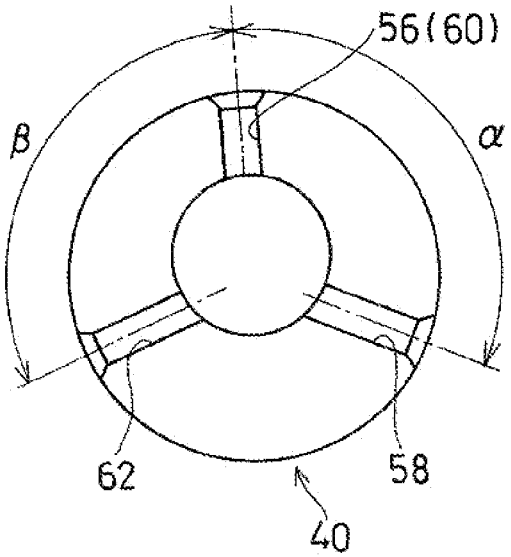
FIG. 13 shows the angular positions of oil holes in said crankpin.

More specifically, as shown in FIG. 13, the second oil hole 58 is open to a point that is offset in a circumferential direction by an angle $\alpha$ from the points to which the first and third oil holes 56 and 60 are open. Meanwhile, the fourth oil hole 62 is open to a point that is offset by an angle $\theta$ from the points to which the first and third oil holes 56 and 60 are open, in a circumferential direction opposite to the direction of the second oil hole 58. The position of each of the oil holes 56, 58, 60, and 62 is not limited to that according to the present embodiment and may be any position, as long as they are open to a point that allows an oil jet to be directed to intended parts that will be discussed later. As shown in FIG. 11, each of the connecting rods 46A and 46B includes an oil channel 64 defined in said interior circumferential surface of a big end thereof. The oil channel 64 is a channel recessed in the interior circumferential surface of the connecting rods 46A, 46B and extending in circumferential direction in said interior circumferential surface of the connecting rods 46A and 46B. While the crankshaft 2 is in rotation, the oil holes 56, 58, 60, and 62 in the crankpin 40 move across the oil channel 64, during which the oil passage 54 fluidly communicates with the oil channel 64.

Each of the connecting rods 46A and 46B includes an oil jet hole 65 defined in an outer peripheral surface of a big end thereof. The oil jet hole 65 is in communication with the oil channel 64. Hence, when the oil passage 54 fluidly communicates with the oil channel 64 during rotation of the crankshaft 2, an oil jet is produced from the oil jet hole 65.

An operation of oil jet structure according to the present embodiment will be explained. Upon the start of the engine E, the pistons 44A and 44B undergo a reciprocating motion that causes the crankshaft 2 coupled thereto through the connecting rods 46A and 46B to rotate in a direction R1. Referring to FIG. 2, rotation of the crankshaft 2, in turn, causes rotations of the camshaft 6 and the pump shaft 8 that are geared thereto. This causes the intake and exhaust valves to open and close, and also, forces oil to be fed to various parts including the oil passage 54 shown in FIG. 11.

While the crankshaft 2 is in rotation, the oil holes 56, 58, 60, and 62 in the crankpin 40 move across the oil channel 64, during which the oil passage 54 fluidly communicates with the oil channel 64 and thereby produces an oil jet from the oil jet hole 65.

The first and third oil holes 56 and 60 are positioned in such a way that produces an oil jet directed towards rear sides of the gudgeon pins 45A and 45B as indicated with an arrow A1. Meanwhile, the second and fourth oil holes 58 and 62 are positioned in such a way that produces an oil jet directed towards the camshaft 6 as indicated with an arrow A2.

More specifically, in the present embodiment, the oil jet generated via the second and fourth oil holes 58 and 62 impinges on walls of the cylinders 41 and 42 in the vicinity of the camshaft 6, as indicated with the arrow A2. This oil disperses upon impingement on the walls of the cylinders 41 and 42, and a portion of the oil adheres to the camshaft 6. Further, the oil adhered to the camshaft 6 is scattered due to the centrifugal force from the rotation of the camshaft 6, and a portion thereof reaches the rocker chamber 69 by moving through each of the rod passages 50A and 50B as indicated with an arrow A3. In this way, sliding areas of the camshaft 6 and the push rods 52A and 52B can be lubricated.

In the aforementioned configuration, the addition of the second and fourth oil holes 58 and 62 to the crankpin 40 enables the sliding areas of the camshaft 6 and the push rods 52A and 52B to be lubricated without creating a complicated structure. Although, in the aforementioned embodiment, the second and fourth oil holes 58 and 62 are positioned in such a way that causes the oil to impinge on the walls of the cylinders 41 and 42, the second and fourth oil holes 58 and 62 may optionally be positioned in such a way that causes the oil jet to directly hit the camshaft 6.

The present disclosure is not only applicable to a V engine, but can also be applied to a single-cylinder engine. Although suitable for application to a vertical shaft engine, the present disclosure can also be applied to other types of engine. For example, the present disclosure can also be applied to an engine with a crankshaft that extends in a horizontal direction.

The camshaft 6 and the pump shaft 8 in the aforementioned embodiment may be configured as separable components. Alternatively, the pump shaft 8 may couple to a rotational component, which is different from the camshaft 6 and interlockingly rotates with the crankshaft 2. The lubricant is not limited to oil, as long as the pump can deliver the lubricant. Moreover, the pump rotor 12 may be of a known pump design other than a trochoid type, as long as the pump rotor 12 is configured for unitary rotation with the pump shaft 8.

Although guidance of the insertion section 8*b* in the second area 18*a*2 is used to prevent the protrusions 22 from hitting the sliding surface 18*a*1, a guide element other than the second area 18*a*2 may be formed and used to guide the insertion section 8*b*. For example, insertion of the insertion section 8*b* into the bore in the pump rotor 12 can be used to assist in keeping the protrusions 22 from hitting the sliding surface 18*a*1, in the same manner as the second area 18*a*2. The axial length L3 measured from one end face of the insertion section 8*b* in the axial direction of the pump shaft 8 to the protrusions 22 can be selected to be greater than an axial length measured from an end face of the pump cover 16 to the second area 18*a*2, in order to use the second area 18*a*2 to guide the insertion section 8*b*.

The pump shaft 8 may be of a non-stepped configuration. By forming an oil passage for a bearing, possible damage to the sliding surface and the flange abutment surface can be prevented. Here, such damage can be more suitably prevented with the use of a crankshaft 2 that extends in a vertical direction.

Although, in the aforementioned embodiment, the pump shaft support is implemented by the crankcase body 4*a* and the additional shaft is implemented by the crankshaft 2, they are not limited thereto. The use can be made of a subassembly configuration in which the pump shaft and a positioning shaft different from the crankshaft, e.g., a knock pin, are integrally supported thereon.

It is to be understood that the present disclosure is not limited to the foregoing embodiments in the sense that various additions, changes, and omissions can be made therein without departing from the principal idea of the present disclosure. Referring to FIG. 2, for instance, the second area 18*a*2 of the through bore 18*a* in the aforementioned embodiment has a circular cross section, but a circular shape is a non-limiting example thereof. Specifically, a gap between the insertion section 8*b* of the pump shaft 8 and the pump cover 16, when viewed in a cross section perpendicular to an axial direction of the pump shaft 8, can be formed such that a gap component in a direction perpendicular to a direction in which the protrusions 22 extend is smaller than a gap component in said direction in which the protrusions 22 extend. By imparting such directionality to the gap, misalignment of the pump shaft 8 relative to the pump cover 16 can be prevented while making it also possible to keep the protrusions 22 from hitting the pump cover 16. The through bore 18*a* may have a cross section that is, for example, elliptical. In this case, the elliptic major axis is preferably defined in a direction in which the protrusions 22 extend. Thus, such a configuration is also encompassed in the present disclosure.

What is claimed is:

1. A pump shaft support structure comprising:

a crankcase body which rotatably supports a crankshaft of an engine;

a pump shaft which interlockingly rotates with the crankshaft, the pump shaft including a supported section that is rotatably supported and an insertion section adjoining one side of the supported section in an axial direction of the pump shaft;

a crankcase cover which covers the crankcase body;

a pump cover which is coupled to the crankcase cover to define a pump chamber between the pump cover and the crankcase cover and which rotatably supports the supported section of the pump shaft on the other side of the pump chamber from the crankcase cover, the pump cover having a through bore that passes the insertion section of the pump shaft therethrough; and a pump rotor which is disposed in the pump chamber and engages with the insertion section of the pump shaft, wherein the insertion section of the pump shaft has a diameter smaller than a diameter of the supported section, and the insertion section has a first axial length greater than a second axial length of the through bore.

2. The pump shaft support structure as claimed in claim 1, wherein:

the pump shaft includes a protrusion protruding radially from an outer peripheral surface of the insertion section, which protrusion engages the pump rotor for fixed rotation therewith; and a third axial length measured from an end face of the insertion section on one side in the axial direction of the pump shaft to the protrusion is greater than the second axial length of the through bore.

3. The pump shaft support structure as claimed in claim 2, wherein the insertion section includes an extension protruding from one side in an axial direction of the pump shaft from the pump rotor when the protrusion is in engagement with the pump rotor, and the crankcase cover has an accommodation space defined therein to accommodate the extension.

4. The pump shaft support structure as claimed in claim 1, wherein the pump cover has a lubricant passage defined in an inner peripheral surface of a bearing section of the pump cover so as to guide a lubricant pumped from the pump chamber.

5. The pump shaft support structure as claimed in claim 1, wherein the pump shaft includes a flange section which comes into abutment with an end face of the pump cover.

6. The pump shaft support structure as claimed in claim 5, wherein the pump cover has a passage defined in an end face of the pump cover, with which the flange section comes into abutment, so as to guide a lubricant pumped from the pump chamber.

7. The pump shaft support structure as claimed in claim 5, wherein the pump shaft extends in a vertical direction, and the pump chamber is located downwards of the pump cover.

8. The pump shaft support structure as claimed in claim 5, wherein the pump shaft is coaxial to and of one-piece construction with a camshaft, and the camshaft is supported by the crankcase at one end of the camshaft which faces away from the pump shaft.

9. The pump shaft support structure as claimed in claim 8, wherein the pump shaft support structure is configured such that the insertion section of the pump shaft is inserted into and passes through the pump cover while the crankshaft is in retaining engagement with the crankcase.

10. A pump shaft support structure comprising:

a crankcase body which rotatably supports a crankshaft of an engine;

a pump shaft which interlockingly rotates with the crankshaft, the pump shaft including a supported section that is rotatably supported and an insertion section adjoining one side of the supported section in an axial direction of the pump shaft;

a crankcase cover which covers the crankcase body;

a pump cover which is coupled to the crankcase cover to define a pump chamber between the pump cover and the crankcase cover and which rotatably supports the supported section of the pump shaft on the other side of the pump chamber from the crankcase cover, the pump cover having a through bore that passes the insertion section of the pump shaft therethrough; and a pump rotor which is disposed in the pump chamber and engages with the insertion section of the pump shaft, wherein:

the insertion section of the pump shaft has a diameter smaller than a diameter of the supported section;

the through bore has a first area, and a second area which is positioned proximal to the pump chamber such that the first area is positioned distal from the pump chamber;

the first area has a diameter corresponding to the supported section of the pump shaft; and the second area has a diameter smaller than the diameter of the first area and greater than the diameter of the insertion section.

11. A pump shaft support structure comprising:

a crankcase body which rotatably supports a crankshaft of an engine;

a pump shaft which interlockingly rotates with the crankshaft, the pump shaft including a supported section that is rotatably supported and an insertion section adjoining one side of the supported section in an axial direction of the pump shaft;

a crankcase cover which covers the crankcase body;

a pump cover which is coupled to the crankcase cover to define a pump chamber between the pump cover and the crankcase cover and rotatably supports the supported section of the pump shaft on the other side of the pump chamber from the crankcase cover, the pump cover having a through bore configured to pass the insertion section of the pump shaft therethrough; and a pump rotor which is disposed in the pump chamber and engages with the insertion section of the pump shaft, wherein the pump shaft includes a flange section which comes into abutment with an end face of the pump cover, the insertion section of the pump shaft includes an extension protruding from one side of the pump rotor in the axial direction of the pump shaft, the crankcase cover has an accommodation space which accommodates the extension of the insertion section in a non-contact manner, the pump cover has an oil supply passage defined in said end face of the pump cover, with which the flange section comes into abutment, so as to guide oil pumped from the pump chamber, and the pump cover has an oil passage defined in an inner peripheral surface of a bearing section of the pump cover, wherein the oil passage is in the form of a channel defined in the inner peripheral surface of the bearing section so as to extend in the axial direction and communicates with the oil supply passage.

12. The pump shaft support structure as claimed in claim 11, wherein the pump shaft extends in a vertical direction, and a weight of the pump shaft is supported on said end face of the pump cover.

13. The pump shaft support structure as claimed in claim 11, wherein the pump shaft is coaxial to and of one-piece construction with a camshaft.

14. An engine comprising the pump shaft support structure as claimed in claim 1.

* * * * *